United States Patent [19]

Farris

[11] Patent Number: 4,535,657

[45] Date of Patent: Aug. 20, 1985

[54] SOCKET WRENCH HAVING AUTOMATIC NUT-EJECTING CAPABILITY

[76] Inventor: Eugene A. Farris, R.R. #1, Murray, Nebr. 68409

[21] Appl. No.: 621,610

[22] Filed: Jun. 18, 1984

[51] Int. Cl.[3] ..... B25B 13/02

[52] U.S. Cl. ..... 81/124.1

[58] Field of Search ..... 81/124.1

[56] References Cited

U.S. PATENT DOCUMENTS 1,566,760 12/1925 Michel ..... 81/124.1

2,488,894 11/1949 Barrett ..... 81/124.1

FOREIGN PATENT DOCUMENTS 2033279 5/1980 United Kingdom ..... 81/124.1

*Primary Examiner*—James L. Jones, Jr.

*Attorney, Agent, or Firm*—George R. Nimmer

[57] ABSTRACT

Well known in the prior art are rudimentary socket wrenches devoid of nut-ejecting capability. Such rudimentary socket wrenches are typically in the form of a tubular sleeve wherein the longitudinal bore internal-wall includes therealong: a fitting-length of noncircular cross-sectional shape whereby the sleeve might be removably mounted to a selectable driving means; a medial-length; and finally a fastener-length having a hexagonal or other regular polygonal cross-sectional shape whereby the driveable sleeve might grippably engage a nut fastener. The nut-ejecting socket wrench of the present invention is generally based upon a rudimentary socket wrench, but having the following structural modifications and additional parts:

providing for the sleeve bore internal-wall a groove-length interrupting a minor proportion of the sleeve medial-length nearer to the fastener-length than to the fitting-length;

installing a helical spring within the sleeve medial-length between the fitting-length and the provided groove-length;

installing a necked hollow plunger in slidable condition within the sleeve medial-length and wherein an enlarged trail-bore portion surrounds the helical spring; and installing a C-shaped retainer within the sleeve groove-length and thereby maintaining the reciprocatable plunger neck in nut-ejecting condition within the sleeve fastener-length.

8 Claims, 11 Drawing Figures

FIG. 1 (PRIOR ART)
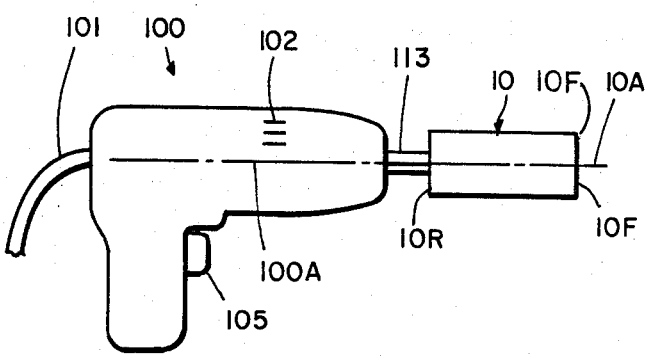
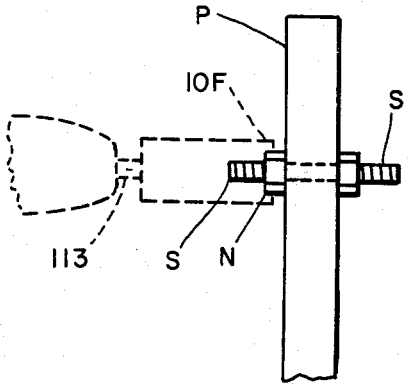
FIG. 2 (PRIOR ART)
FIG. 3 (PRIOR ART)
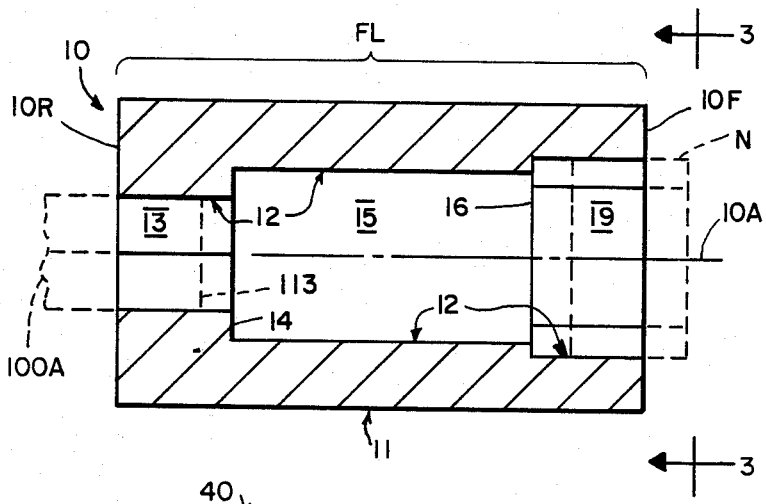
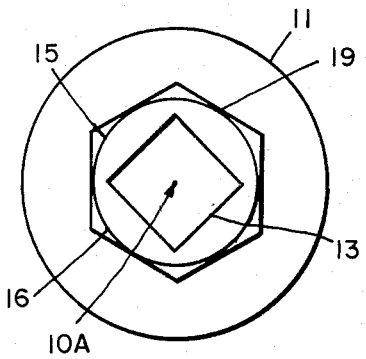
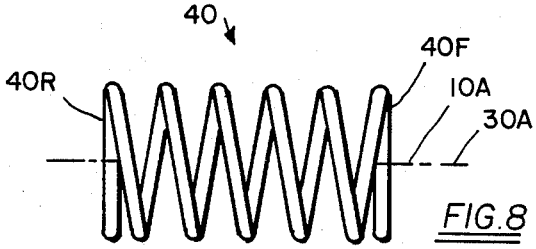
FIG. 8
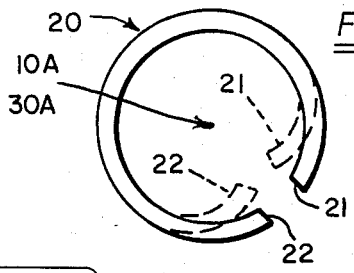
FIG. 5
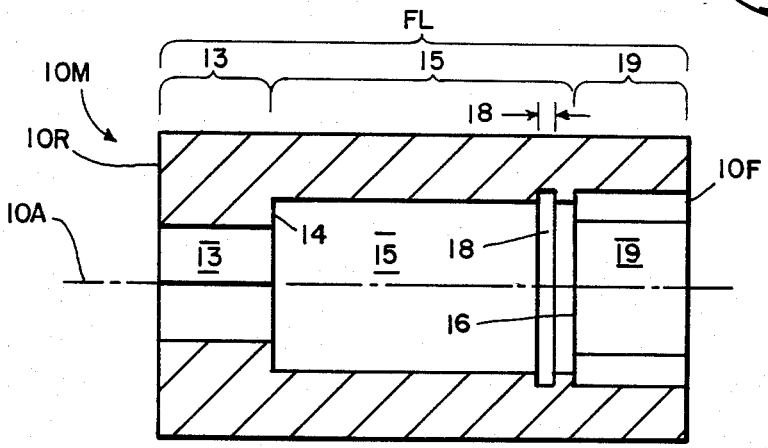
FIG. 4

FIG. 10
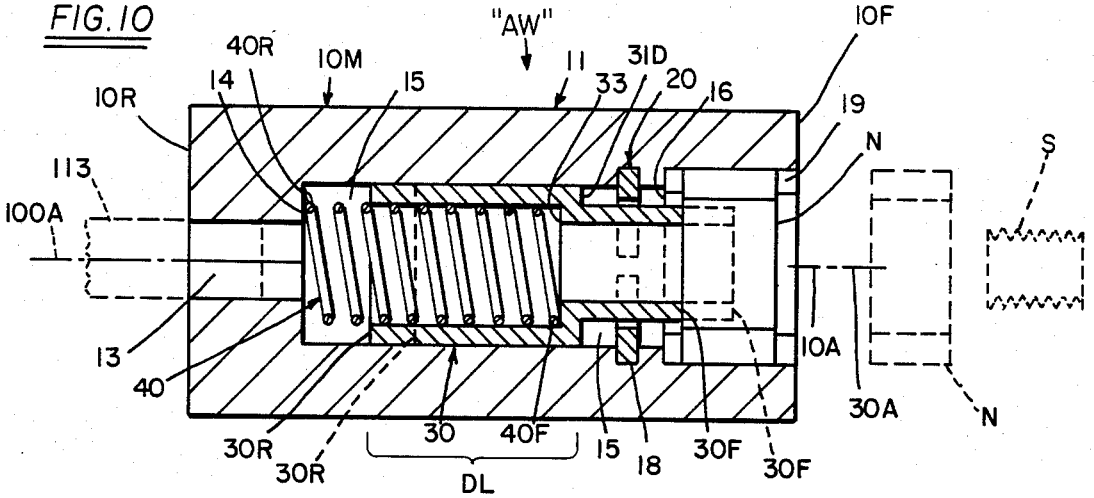
FIG. 9
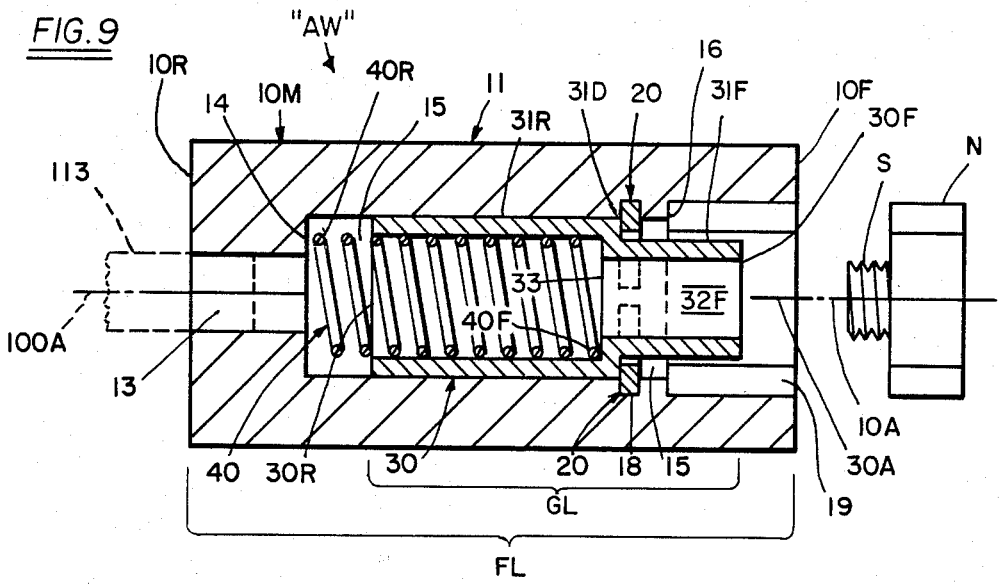
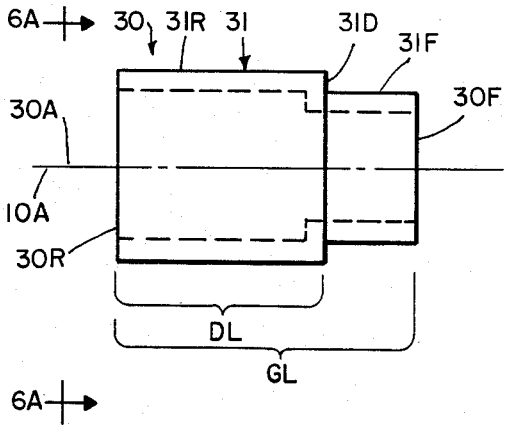
FIG. 6
FIG. 7
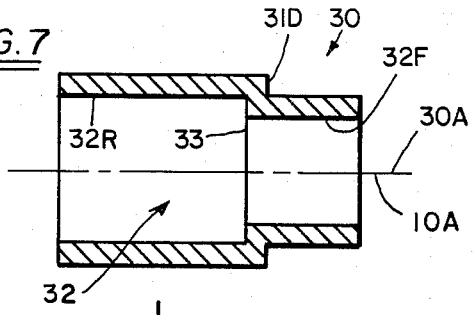
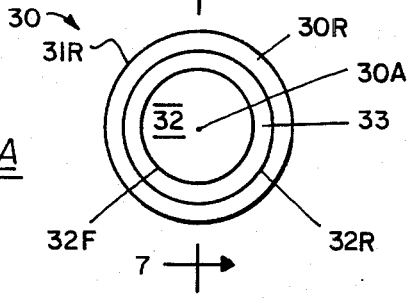
FIG. 6A

SOCKET WRENCH HAVING AUTOMATIC NUT-EJECTING CAPABILITY

BACKGROUND OF THE INVENTION

As alluded to in drawing FIGS. 1-3, rudimentary socket wrenches devoid of nut-ejecting capability are well known in the prior art. Drawing FIG. 1 is a longitudinally extending side elevational view, FIG. 2 is a detail sectional view of FIG. 1, and FIG. 3 is a a transversely extending elevational view (taken along line 3—3 of FIG. 2), of a rudimentary socket wrench 10. The typical prior art socket wrench 10 of FIGS. 1-3 comprises a tubular sleeve (10) surrounding a longitudinally extending central sleeve-axis 10A and having a nut ("N") gripping front-end 10F and a driveable (100) rear-end 10R respectively perpendicular to sleeve-axis 10A. Socket sleeve 10 includes an external-wall 11 circularly surrounding sleeve-axis 10A and a bore defining internal-wall 12 along sleeve-axis 10A whereby walls 11 and 12 each has a finite-length "FL" extending leadwardly from rear-end 10R to front-end 10F.

Longitudinally extending sleeve internal-wall 12 includes three consecutively longitudinally extending length portions along finite-length "FL" as follows:

(i) a fitting-length 13 commencing at sleeve rear-end 10R and having a non-circular cross-sectional shape for removable mounting to a selectable socket wrench driving means. For example, the shape might be rectangular for removably frictionally accommodating the rectangular driving shaft 113 of an air-powered gun driving means 100;

(ii) a medial-length 15 commencing at the forward terminus (14) of fitting-length 13 and having a circular cross-sectional shape larger than that for the fitting-length whereby an abrupt sleeve-shoulder 14 (at the juncture of lengths 13 and 15) circularly surrounds sleeve-axis 10A, and said medial-length 15 providing the major proportion of sleeve internal-wall finite-length "FL"; and (iii) a fastener-length 19 commencing at the forward terminus 16 of medial-length 15, said fastener-length 19 being of regular polygonal cross-sectional shape for conformably gripping a polygonal cross-sectional nut fastener (e.g. "N") for disengagement from a threaded stud ("S") therefor. For a hexagonal nut "N", the fastener-length 19 has a matching hexagonal cross-sectional size.

Operation of the above described art socket wrench 10, and for a typical purpose of rotatably disengaging hexagonal nut "N" from a threaded stud "S" protruding from a panel "P", is typically as follows. As an arbitrarily selected driving means for rotating socket wrench 10 about its sleeve-axis 10A, there is shown an air-powered (e.g. via airline 101) gun 100 having its powerably rotatable shaft 113 extending along longitudinal-axis 100A alignable with sleeve-axis 10A within fitting-length 13. Then, as alluded to in FIG. 1 phantom lines, the combination (10+100) is brought toward stud "S" so that sleeve fastener-length 19 grippably surrounds hexagonal nut "N". Next, the operator actuates airline switch 105 causing shaft 113 and socket wrench 10 to co-rotate about colinear axes 100A and 10A whereby nut "N" becomes disengaged from stud "S" as alluded to in FIG. 2 phantom line. However, because of the necessarily close cross-sectional sizes of fitting-length 19 and nut "N", and as alluded to in FIG. 2 phantom line, it is oftentimes difficult for the operator to dislodge the stud disengaged fastener nut from the socket wrench (10).

OBJECT OF THE INVENTION

In view of the afore alluded to difficulty in dislodging a stud disengaged nut from prior art rudimentary socket wrenches, it is accordingly the general objective of the present invention to provide an improved socket wrench having automatic nut-ejecting capability whereby the stud disengaged nut need not be laboriously pried away from the socket wrench by the operator. Ancillary general objectives include providing a socket wrench having fully automatic nut-ejecting capability which is: simple and economical to manufacture in various cross-sectional sizes; reliable to use in typically encountered useage situations; and relatively free of break-down and maintenance problems.

PRIOR ART KNOWN TO APPLICANT

U.S. Pat. Nos. 2,651,229 (Lenz—Sept. 8, 1953); 2,470,399 (Holben—May 17, 1949); and 3,224,302 (Cooley—Dec. 21, 1965).

GENERAL STATEMENT OF THE INVENTION

With the above general objectives in view, and other specific objectives which will become more apparent as this description proceeds, the automatically nut-ejecting socket wrench of the present invention generally comprises:

(a) the utilization of a sleeve member which is generally closely related to, and even possibly structurally based upon, a rudimentary prior art socket wrench (e.g. 10) though necessarily further provided with a very short groove-length that interrupts a minor proportion of the sleeve internal-wall medial-length;

(b) installing a longitudinally extending and rearwardly resiliently compressible helical spring within the sleeve medial-length between the fitting-length and the groove-length;

(c) installing a necked hollow plunger in longitudinally slidable condition within the sleeve medial-length and surrounding the helical spring whereby the plunger necked portion extends into a nut-ejecting reciprocatable condition within the sleeve fastener-length;

(d) installing a C-shaped retainer in the sleeve groove-length and in closely surrounding relationship to the plunger necked portion and as a stop means for the plunger enlarged portion; and (e) providing nut impact prevention means for preventing a wrench disengaged nut fastener from impacting against the C-shaped retainer.

BRIEF DESCRIPTION OF THE DRAWING

In the drawing, wherein like characters refer to like parts in the several views, and in which:

FIGS. 1-3 are directed to the aforedescribed rudimentary prior art socket wrench (10) devoid of automatic nut-ejecting capability;

FIG. 4 is a sectional elevational view akin to FIG. 2 of a sleeve member 10M utilized for the representative nut-ejecting wrench embodiment "AW" depicted in FIGS. 9 and 10;

FIG. 5 is a transversely extending elevational view of a C-shaped retainer member 20 utilized for wrench embodiment "AW";

FIG. 6 is a longitudinally extending side elevational view of a hollow necked plunger 30 utilized for wrench embodiment "AW";

FIG. 6A is a transversely extending elevational view taken along line 6A—6A of FIG. 6;

FIG. 7 is a longitudinally extending sectional elevational view of the FIGS. 6 and 6A plunger member;

FIG. 8 is a longitudinally extending side elevational view of a longitudinally compressible helical spring member 40 utilized for wrench embodiment "AW";

FIG. 9 is a longitudinally extending sectional elevational view akin to FIG. 2 of representative nut-ejecting wrench embodiment "AW" ready to receive a nut fastener for disengagement from a threaded stud therefor; and FIG. 10 is a longitudinally extending sectional elevational view akin to FIG. 9 showing embodiment "AW" actually gripping the nut fastener (solid lines) and thereafter automatically ejecting the nut fastener (phantom lines).

DETAILED DESCRIPTION OF THE DRAWING

Prepatory to describing representative nut-ejecting wrench "AW" of FIGS. 9 and 10, the four constituent parts thereof will first be described in detail. These four constituent parts (and each of them surrounding central sleeve-axis 10A) are as follows:

- sleeve member 10M of FIG. 4 which (except for groove-length 18 surrounding sleeve-axis 10A) is identical to prior art sleeve member 10,
- C-shaped retainer 20 of FIG. 5 which is installable as a stop means (for plunger 30) within groove-length 18 of sleeve 10M,
- necked plunger member 30 of FIGS. 6–7 which is slidably installable within the medial-length 15 of sleeve 10M and in a condition wherein the plunger neck 31F is surrounded by C-shaped retainer 20 and sleeve fastener-length 19, and
- helical spring 40 of FIG. 8 which normally urges the plunger enlarged portion (31D) against the stop means retainer 20.

As seen in drawing FIG. 4, sleeve member 10M may be substantially identical to prior art sleeve member 10, the essential difference being that there is further provided a groove-length 18 (herein circularly surrounding central sleeve-axis 10A) which interrupts a minor proportion of medial-length 15 nearer to fastener-length 19 than to fitting-length 13. Thus, groove-length 18 has a circular cross-sectional size larger than that for medial-length 15.

As seen in drawing FIGS. 6, 6A, and 7, plunger member 30 surrounds a central plunger-axis 30A that is colinearly superimposable along said sleeve-axis 10A and having a forward lead-end 30F and a rearward trail-end 30R respectively substantially transversely perpendicularly intersecting plunger-axis 30A. Between said ends 30F and 30R, plunger 30 has a longitudinally extending given-length "GL" which is less than said sleeve finite-length "FL", and which is also less than the sleeve internal-length from sleeve-shoulder 14 to front-end 10F.

Plunger 30 has an outside-wall 31 longitudinally extending from lead-end 30F to trail-end 30R, said outside-wall 31 including a lengthier ("DL") and relatively cross-sectionally enlarged trail-length trail-length 31R circularly surrounding plunger-axis 30A and also including a shorter and necked lead-length 31F circularly surrounding plunger-axis 30A whereby an outside-wall vertical riser 31D exists at the juncture of lead-length 31F and trail-length 31R. Plunger trail-length 31R is sufficiently arrested in longitudinal extent "DL" (i.e. from 30R to 31D) to be longitudinally slidably disposable within sleeve medial-length 15 between sleeve-shoulder 14 and the groove-length 18.

Plunger 30 is at least partially hollow including a lead-bore 32F circularly surrounding plunger-axis 30A and extending longitudinally trailwardly from plunger lead-end 30F and also including a trail-bore 32R circularly surrounding plunger-axis 30A and extending longitudinally leadwardly from plunger trail-end 30R. Leadwardly remote of plunger trail-end 30R, trail-bore 32R terminates as an abrupt plunger-shoulder 33 circularly surrounding plunger-axis 30A. Herein, the cross-sectionally larger trail-bore 32R intersects the cross-sectionally smaller lead-bore 32F at plunger-shoulder 33 whereby plunger embodiment 30 is fully tubularly hollow having a single longitudinal bore 32 of said given-length "GL". The existence of such single longitudinal bore 32 prevents a relatively lengthy stud "S" from interfering with the nut-ejecting capability of the wrench alluded to in drawing FIGS. 9 and 10.

As seen in drawing FIG. 5, C-shaped retainer member 20 has its two ends 21 and 22 positioned quite closely together whereby member 20 has a substantially fully-closed circular shape surrounding colinear axes 10A and 30A. The outside-diameter of member 20 is substantially equal to the diameter of groove-length 18, and the circular inside-opening area of member 20 is less than the cross-sectional area for sleeve internal-wall medial-length 15 and is intermediate in cross-sectional size to the plunger outside-wall trail-length 31R and lead-length 31F. As indicated in FIG. 5 phantom lines, a metallic C-shaped member is manually resiliently constrictable whereby it might be compressed with tongs or the like for insertion through the relatively smaller sleeve fastener-length 19 and securely seatably installed as a stop means within sleeve groove-length 18.

As seen in drawing FIG. 8, the longitudinally rearwardly compressible metallic helical spring 40 surrounds colinear axes 10A and 30A and includes transversely extending spring ends 40R and 40F for bearing against sleeve-shoulder 14 and plunger-shoulder 33, respectively.

Having now described the four constituent parts 10M, 20, 30, and 40, shown in drawing FIGS. 4–8, they are assembled together in the following manner to provide representative nut-ejecting wrench "AW" of FIG. 9. First, the helical spring 40 is installably inserted into internal-wall 12 of sleeve 10M so that spring end 40R rests against sleeve-shoulder 14. Second, plunger 30 is coaxially installably inserted into the same internal-wall 12 so that its outside-wall trail-length 31R becomes slidably engaged along sleeve medial-length 15 rearwardly of groove-length 18 and so that plunger trail-bore 32R surrounds spring 40 whereby spring end 40F rests against plunger-shoulder 33. Thirdly, C-shaped retainer member 20 is seated by its own expansion pressure within groove-length 18 in the manner previously alluded to whereby retainer member 20 exists as a forward stop means for plunger 30 at riser 31D. These three assembly steps result in the nut-ejecting wrench "AW" depicted in FIG. 9 wherein spring 40 normally maintains plunger riser 31D against C-shaped stop means 20 and the plunger necked portion 31F extends therebeyond into the fastener-length 19 of sleeve member 10M. In the latter regard, and as seen in FIG. 9, the longitudinal length of plunger neck 31F is empirically chosen so that the normal spring-urged longitudinal position for plunger lead-end 30F is intermediate the transversely extending terminii 16 and 10F of the sleeve 10M fastener-length 19.

There are nut impact prevention means for preventing a nut fastener from impacting trailwardly against the C-shaped retainer (e.g. 20) immediately prior to being leadwardly ejected by the resiliently longitudinally movable plunger. Such means will be furnished if the sleeve internal-wall fastener-length (19) cross-sectional size (which is necessarily substantially equal to that for the encountered nut fastener "N") is slightly larger than the forward extremity (e.g. 16) of the sleeve medial-length. Alternatively, such means will be furnished if the plunger given-length (e.g. "GL") exceeds the sleeve internal-wall medial-length (e.g. from 14 to 16), it being understood that the plunger trail-length 31R is necessarily lengthier than plunger lead-length 31F.

Although already having been alluded to, operation of the representative nut-ejecting wrench "AW" might be summarized as follows. In the first operational step, and as indicated in FIG. 9, the combination of wrench "AW" and a driving means (e.g. at 113) is brought toward and in surrounding relationship to stud "S" having nut "N". In the second step, and as alluded to in FIG. 10 solid line, actuation of driving means 113 causes nut "N" (gripped within fastener-length 19) to progressively rotate about stud "S", said nut pressing against and causing a trailward movement of plunger 30. Finally, when nut "N" has become rotatably disengaged from stud "S", and as indicated in FIG. 10 phantom line, helical spring 40 causes plunger ridge 31D to return to its normal position against retainer 20, thereby automatically ejecting nut "N" from the wrench fastener-length 19.

From the foregoing, the construction and operation of the socket wrench having automatic nut-ejecting capability will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

What is claimed is as follows:

1. A socket wrench having automatic nut ejector capability and comprising:

A. a tubular sleeve surrounding a longitudinally extending central sleeve-axis and having a front-end and a rear-end respectively substantially perpendicular to said sleeve—axis, said tubular sleeve having an internal-wall having a finite-length extending leadwardly from rear-end to front-end and including four consecutively longitudinally extending length portions along said finite-length as follows:

Ai. a fitting-length commencing at the sleeve rear-end and having a noncircular cross-sectional shape whereby the socket wrench sleeve might be removably mounted to a selectable socket driving means, Aii. a relatively lengthy medial-length commencing at the forward terminus of the fitting-length and having a cross-sectional shape that is larger than that for the fitting-length whereby an abrupt sleeve-shoulder surrounding the sleeve-axis exists at the juncture of the fitting-length and the medial-length, said medial-length providing the major proportion of the sleeve internal-wall finite-length, Aiii. a fastener-length commencing at the forward terminus of the medial-length, said fastener-length at the sleeve-front-end being of regular polygonal cross-sectional shape whereby the socket wrench sleeve might grip a polygonal nut fastener for disengagement from a threaded stud therefor, and Aiv. a groove-length interrupting a minor proportion of said medial-length nearer the fastener-length than to the fitting-length, said groove-length circularly surrounding the sleeve-axis and having a circularly cross-sectional size larger than that for the medial-length;

B. a hollow plunger surrounding a longitudinally extending central plunger-axis that is superimposable along said sleeve-axis and having a forward lead-end and a rearward trail-end respectively substantially perpendicular to said plunger-axis, said lead-end and trail-end defining therebetween a plunger given-length that is less than the sleeve internal-wall finite-length, Bi. said plunger having an outside-wall extending from lead-end to trail-end, said plunger outside-wall including a lengthier and relatively cross-sectionally enlarged trail-length surrounding the plunger-axis and being longitudinally slidably engaged along a major proportion of the sleeve internal-wall medial-length rearwardly of the groove-length, said plunger outside-wall also including a shorter and necked lead-length surrounded by the sleeve groove-length and terminating at the plunger lead-end, said plunger lead-length being sufficiently longitudinally arrested with respect to the groove-length that the plunger lead-end is permanently rearwardly recessed from the sleeve front-end, and Bii. said hollow plunger including a lead-bore extending trailwardly from the plunger lead-end and also including a trail-bore extending longitudinally leadwardly from the plunger trail-end and being cross-sectionally larger than said lead-bore, said trail-bore leadwardly remote of the plunger trail-end including an abrupt plunger-shoulder;

C. a longitudinally rearwardly compressible helical spring surrounding the colinear sleeve-axis and plunger-axis and bearing between the sleeve-shoulder and the plunger-shoulder and resiliently yieldably urging the plunger enlarged trail-length toward the sleeve internal-wall groove-length;

D. a C-shaped retainer seated within the sleeve groove-length and having a substantially fully-closed circular shape wherein the inside-opening area thereof is less than the cross-sectional area for the sleeve internal-wall medial-length and is intermediate in cross-sectional size to that for the plunger outside-wall trail-length and lead-length whereby the C-shaped retainer maintains the cross-sectionally enlarged trail-length permanently trailwardly thereof and the plunger lead-end leadwardly thereof for nut ejecting capability; and E. nut impact prevention means for preventing a said disengaged nut fastener from impacting trailwardly against the C-shaped retainer immediately prior to the nut being leadwardly ejected from the sleeve fastener-length by the resiliently longitudinally movable plunger.

2. The socket wrench of claim 1 wherein the nut impact prevention means comprises providing the sleeve internal-wall fastener-length cross-sectionally larger than the forward extremity of the sleeve internal-wall medial-length.

3. The socket wrench of claim 1 wherein the nut impact prevention means comprises providing the plunger trail-length longitudinally lengthier than the plunger lead-length and having the plunger overall longitudinal length exceeding that for the sleeve internal-wall medial-length.

4. The socket wrench of claim 1 wherein the plunger lead-bore intersects the plunger trail-bore at said plunger-shoulder whereby the plunger is fully tubularly hollow from lead-end to trail-end whereby a longitudinally elongated threadedly engaged stud anchor for the nut fastener is less likely to interfere with the sleeve fastener-length from gripping the polygonal nut fastener.

5. The socket wrench of claim 4 wherein the plunger lead-bore and the trail-bore respectively circularly surround the plunger-axis.

6. The socket wrench of claim 1 wherein the sleeve internal-wall medial-length circularly surrounds the sleeve-axis.

7. The socket wrench of claim 6 wherein the plunger outside-wall along the entire trail-length thereof circularly surrounds the plunger-axis.

8. The socket wrench of claim 7 wherein the plunger outside-wall along the entire necked lead-length thereof circularly surrounds the plunger-axis.

* * * * *